US005527404A

United States Patent [19]

Warren

[11] Patent Number: 5,527,404

[45] Date of Patent: Jun. 18, 1996

[54] VEHICLE FRAME COMPONENTS EXHIBITING ENHANCED ENERGY ABSORPTION, AN ALLOY AND A METHOD FOR THEIR MANUFACTURE

[75] Inventor: Allison S. Warren, Pittsburgh, Pa.

[73] Assignee: Aluminum Company of America, Pittsburgh, Pa.

[21] Appl. No.: 270,994

[22] Filed: Jul. 5, 1994

[51] Int. Cl.[6] ..... C22F 1/04

[52] U.S. Cl. ..... 148/688; 148/516; 148/521; 148/689; 148/690; 148/695; 148/702; 148/415; 148/440; 180/89.1; 280/781; 280/785; 296/187; 296/188; 296/189; 296/193; 296/900; 420/544; 420/547

[58] Field of Search ..... 148/516, 521, 148/688, 689, 690, 695, 702, 415, 440; 420/544, 547; 280/781, 785; 180/89.1; 296/187, 188, 189, 193, 900

[56] References Cited

U.S. PATENT DOCUMENTS

| | | | |
|---|---|---|---|
| 3,222,227 | 12/1965 | Baugh et al. | 148/702 |
| 4,525,326 | 6/1985 | Schwellinger et al. | 420/535 |
| 4,618,163 | 10/1986 | Hasler et al. | 280/785 |
| 4,958,844 | 9/1990 | Hancock | 280/185 |

*Primary Examiner*—David A. Simmons
*Assistant Examiner*—Robert R. Koehler
*Attorney, Agent, or Firm*—Thomas R. Trempus

[57] ABSTRACT

An improved elongate aluminum alloy product, and a method of producing such a product, ideally suited for use as a component in a vehicle frame or subassembly, i.e., body-in-white. The alloy consists of essentially 0.45 to 0.7% magnesium, and about 0.35 to 0.6%, silicon, and about 0.1 to 0.35%, vanadium, and, 0.1–0.4% iron, preferably 0.15 to 0.3%, the balance substantially aluminum and incidental elements and impurities.

60 Claims, 1 Drawing Sheet

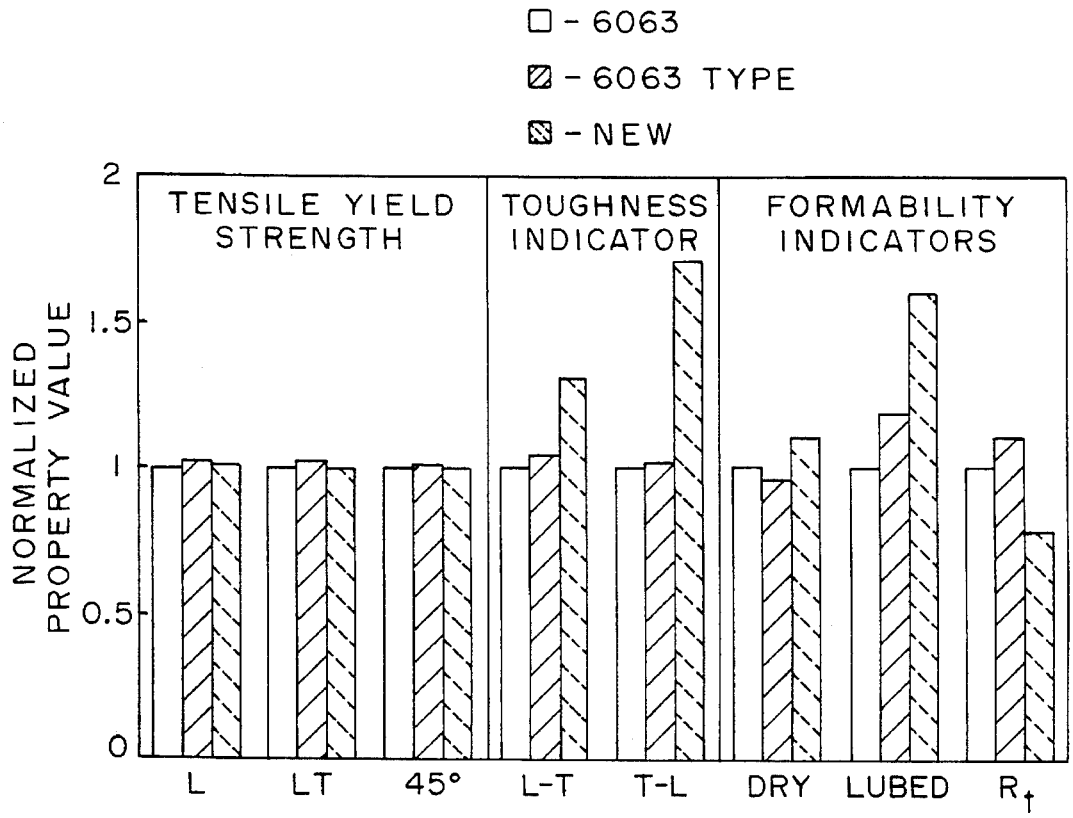
□ - 6063
▨ - 6063 TYPE
▧ - NEW
TENSILE YIELD STRENGTH
TOUGHNESS INDICATOR
FORMABILITY INDICATORS
NORMALIZED PROPERTY VALUE
2
1.5
1
0.5
0
L
LT
45°
L-T
T-L
DRY
LUBED
$R_t$

VEHICLE FRAME COMPONENTS EXHIBITING ENHANCED ENERGY ABSORPTION, AN ALLOY AND A METHOD FOR THEIR MANUFACTURE

This invention concerns a method of producing improved aluminum alloy elongate products and components by operations including extrusion; and specifically improved elongated products and components that are particularly useful in the manufacture of vehicle primary structures.

BACKGROUND

It is known to manufacture a vehicle frame by providing separate subassemblies, each subassembly being composed of several separate components that can include lineal frame members. Each subassembly is manufactured by joining together several members by means of a node structure that can be a cast, extruded, or sheet component. The frames and subassemblies can be assembled by adhesive bonding, welding, or mechanical fastening; or by combinations of these and other joining techniques. An example of such a vehicle frame structure is available in U.S. Pat. No. 4,618,163, entitled "Automotive Chassis" the entire contents of which are incorporated herein by reference. Aluminum alloys are highly desirable for such vehicle frame constructions because they offer low density, good strength and corrosion resistance. Moreover, aluminum alloys can be employed to improve the vehicle frame stiffness and performance characteristics. Use of aluminum provides the potential for environmental benefits and efficiencies through a lightweight aluminum vehicle frame that also demonstrates reduced fuel consumption due to the lightweighting. Finally, the application of aluminum alloy components in a vehicle frames presents an opportunity to ultimately recycle the aluminum components/subassemblies when the useful life of the vehicle is spent. Moreover, it is believed that an aluminum vehicle frame retains the perceived strength and crashworthiness typically associated with much heavier, conventional steel frame vehicle designs.

As suggested above important considerations for aluminum primary automotive body structures include crashworthiness in conjunction with reducing the overall vehicle weight and/or improving vehicle performance. For the automotive application, crashworthiness reflects the ability of a vehicle to sustain some amount of collision impact without incurring unacceptable distortion of the passenger compartment or undue deceleration of the occupants. Upon impact, the structure should deform in a prescribed manner; the energy of deformation absorbed by the structure should balance the kinetic energy of impact; the integrity of the passenger compartment should be maintained; and the primary structure should crush in such a manner as to minimize the occupant deceleration. Various standard tests can be used to evaluate the physical and mechanical properties of an aluminum alloy for use in an automotive structure or other applications. As examples, tensile testing and standard formability tests can be used to provide information on strength and relative performance expectations, or a tear test can be used to examine fracture characteristics and provide a measure of the resistance to crack growth or toughness under either elastic or plastic stresses. These and other test methods are used to examine the general performance of materials representative of those used for the manufacture of vehicle components, subassemblies, and frames. However, few standard tests are available to allow the evaluation of aluminum alloy components intended for use in primary body structures. Accordingly, in addition to the tests described above, it is believed that a static axial crush test allows the evaluation of the response of a vehicle frame component to axial compressive loading. If used for evaluation of component geometries designed to provide absorb energy under compressive loading, the static axial crush test provides the severe conditions necessary to examine a component's response to compressive loading. During the static axial crush test, a specified length of an energy absorbing component is compressively loaded at a predetermined rate creating a final deformed component height of approximately half the original free length or less. Various modes of collapse can be experienced under these conditions; including: regular folding—stable collapse, irregular folding, and bending. The desired response for evaluation of energy absorbing components is stable axial collapse characterized by regular folding. The crushed sample is examined to determine material response to the severe deformation created during this test. It is generally desirable to demonstrate the ability to deform without cracking. In this case, samples are visually examined following static axial crush testing and assigned a rating based on the appearance of the deformed samples. The results of the examination are registered on a scale of from 1 to 3. A "3" indicates that the area proximate the fold shows evidence of open cracking that is often visible to the naked eye and roughening damage. A "3" rated material is considered to be unacceptable. A "2" indicates that the area proximate the folds or displaced side wall material of the extrusion is roughened and may be slightly cracked, but the basic integrity of the side wall is maintained. A sample rated "2" is better than one rated a "3" but not as good as a sample rated "1". A rating of "1" indicates that the crushed extrusion contains no cracking or roughened areas and the folds are substantially smooth; this is the preferred material response following the static axial crush test.

The ability of a structure or structural component to absorb energy and deform in a desired, progressive manner under compressive loading during both static and dynamic crash testing is a function of both the component design, e.g., geometry, cross-section shape, size, length, thickness, joint types included in the assembly, and the properties of the material from which the component is manufactured, i.e., yield and ultimate tensile strength at the actual loading rate, modulus of elasticity, fracture behavior, etc. Various aluminum alloys are potential candidates for the manufacture of a primary body structure which includes such energy absorbing components. For example, 6XXX alloys, could be utilized in the production of extruded components for incorporation into aluminum intensive vehicles. The 6XXX series alloys are a popular family of aluminum alloys, designated as such in accordance with the Aluminum Association system wherein the 6XXX series refers to heat treatable aluminum alloys containing magnesium and silicon as their major alloying additions. Strengthening in the 6XXX alloys is accomplished through precipitation of Mg2Si or its precursors. The 6XXX are widely used in either the naturally aged-T4 or artificially aged-T6 tempers. This series of alloys also commonly includes other elements such as chromium, manganese, or copper, or combinations of these and other elements for purposes of forming additional phases or modifying the strengthening phase to provide improved property combinations.

The 6XXX alloys are commonly used for production of architectural shapes, and because these products are most often used in applications requiring only a minimum strength level the 6XXX alloys typically are air quenched in production due to cost considerations. Alloy 6063 represents one of the most widely used 6XXX products. It provides typical yield strengths of 90 MPa [13 ksi], 145 MPa [21 ksi], and 215 MPa [31 ksi] in the naturally aged-T4 and artificially aged-T5 and -T6 tempers, respectively. By accepted industry convention, both the -T5 and -T6 temper designations for extrusions can refer to a product which has been press quenched and artificially aged in lieu of the strict definition of -T6 that includes a solution heat treatment and quenching operation.

Quenching from elevated temperature processing operations is often critical to the development of properties and performance required of the final product. The objective of quenching is to retain the Mg, Si and other elements in the solid solution resulting from an elevated temperature operation such as extrusion. In the case of extrusion, the product is often quenched as it exits the extrusion press to avoid the additional cost associated with a separate solution heat treatment and quenching operation. Water quenching can be used to provide a fast cooling rate from the extrusion temperature. A fast cooling rate provides the best retention of the elements in solid solution. However water quenching creates the need for additional equipment and can create excessive distortion and the need for subsequent processing to correct the shape prior to use. Air cooling is commonly used for press quenching of 6063 products. Air cooling reduces the distortion experienced and improves dimensional capability in hollow products. However, 6XXX products typically exhibit some quench sensitivity or loss of strength or other properties with reduced quench rates experienced in air quenching. Quench sensitivity is due to precipitation of elements from the solid solution during a slow quench. This precipitation typically occurs on grain boundaries and other heterogeneous sites in the microstructure. Precipitation during the quenching operation makes the solute unavailable for precipitation of strengthening phases during subsequent aging operations. A slow quench typically results in a loss of strength, toughness, formability or corrosion resistance. A slow quench can also adversely effect the fracture performance of the product by promoting low energy grain boundary fracture. Quench sensitivity with respect to yield strength is generally small in dilute alloys such as 6063. However, pronounced quench sensitivity can be observed with respect to toughness and toughness indicators as well as other properties which are strongly influenced by the fracture behavior of the material. Differences are often noted in the results obtained through tear tests, and formability evaluations. Dramatic influences of the quench rate have also been noted in the results obtained using the static axial crush test in common commercial extrusion materials such as 6063. In order to overcome the loss of desired properties, a separate solution heat treatment and quench, or an in line press spray water quench can be used to provide cooling at the required rate to minimize precipitation during quenching. However, as indicated above, water quenching can create distortion, inhibit process speed, require additional processing for dimensional correction, and limit the ability to produce component profiles to tolerance. The strictest of tolerances must be maintained during the assembly of a vehicle subassembly or frame. Quench distortion associated with use of a water quenching operation adversely effects the production of a complex, thin walled, hollow extrusion, potentially distorting it and rendering it out of tolerance for the desired application and in need of further labor intensive correction.

U.S. Pat. No. 4,525,326 teaches that the quench sensitivity with respect to strength of a 6XXX alloy (Si, Fe, Cu, Mg) can be improved by the addition of vanadium. Specifically, the patent discloses the addition of 0.05 to 0.2% vanadium and manganese in a concentration equal to ¼ to ⅔ of the iron concentration to an aluminum alloy for the manufacture of extruded products. Notwithstanding such efforts to develop alloys that offer reduced quench sensitivity with respect to strength; there remains a need for alloys that provide reduced quench sensitivity with respect to static axial crush performance.

An alloy that could be air quenched would provide the ability to produce thin walled hollow extruded shapes meeting the dimensional capabilities desired for assembly of automotive structures and providing the characteristics desired for use in the final structure including good strength and the ability to deform in a regular way in components designed to absorb energy when compressively loaded in the event of a collision; and allow production of these components in a cost effective manner.

It is an object of this invention to provide an aluminum alloy component characterized by excellent static axial crush performance.

It is another object of the invention to provide an aluminum alloy characterized by reduced quench sensitivity with respect to static axial crush performance and other characteristics required for application in automotive structures.

It is also an object of this invention to provide an aluminum alloy capable of an increased range of shapes including thin walled hollow extrusions and improved dimensional capability for use in the manufacture of aluminum intensive vehicles or similar structures.

It is a further object of this invention to provide an improved aluminum alloy.

It is yet an object of this invention to provide a method of manufacturing an improved elongated aluminum alloy product.

SUMMARY OF THE INVENTION

The above as well as other objects of this invention are achieved by way of the instant invention in which the alloy composition is formulated to contain about 0.45 to 0.7% magnesium, preferably about 0.48 to 0.64% magnesium, and about 0.35 to 0.6%, preferably about 0.4 to 0.51% silicon, and about 0.1 to 0.35%, preferably about 0.2% vanadium, and, 0.1–0.4% iron, preferably 0.15 to 0.3%, the balance substantially aluminum and incidental elements and impurities. Unless indicated otherwise, all composition percentages set forth herein are by weight. Additionally, this aluminum alloy demonstrates relatively lower quench sensitive with respect to the static axial crush performance and provides good strength, formability and corrosion resistance. The alloy composition of this invention is therefore ideally suited for air quench yet capable of an increased range of shapes and improved dimensional capability. The quenching process can include the application of a forced air quenching of the extruded product in addition to the steps of homogenization, reheating, extrusion, natural and/or artificial aging.

BRIEF DESCRIPTION OF THE DRAWINGS

The above as well as other features and advantages of the present invention can be more clearly appreciated through consideration of the detailed description of the invention in conjunction with the sole figure which is a graph demonstrating the characteristics of a forced air cooled product according to this invention.

DETAILED DESCRIPTION OF THE INVENTION

In accordance with this invention, the alloy composition is formulated to contain about 0.45 to 0.7% magnesium, preferably about 0.48 to 0.64% magnesium, and about 0.35 to 0.6%, preferably about 0.4 to 0.51% silicon, and about 0.1 to 0.35%, preferably about 0.2% vanadium, and, 0.1–0.4% iron, preferably 0.15 to 0.3%, the balance substantially aluminum and incidental elements and impurities. The alloy composition of this invention is free from the intentional addition of copper and is consistent with the Aluminum Association composition standards for acceptable levels of impurities. The alloy is typically solidified into extrusion ingot by continuous casting or semi-continuous casting into a shape suitable for extrusion which is typically a cylindrical ingot billet. The ingot can be machined or scalped to remove surface imperfections, if desired, or it can be extruded without machining if the surface is suitable. The extrusion process produces a substantially reduced diameter but greatly increased length compared to the extrusion billet. Before extrusion, the metal is typically subjected to thermal treatments to improve workability and properties. The as-cast billet can be homogenized above the Mg2Si solvus temperature to allow dissolution of existing Mg2Si particles and reduce chemical segregation resulting from the casting process. Following homogenization, ingot can be allowed to air cool. Prior to extrusion, billets are reheated to the hot working temperature and extruded by direct or indirect extrusion practices. It is an important preference in practicing the invention that extrusion be conducted at cylinder temperatures just before extrusion which are typically 50°–100° F. less than that of the extrusion; typically within the range of about 700° F. up to about 1000° F., preferably at a temperature of 900° F.

Extrusion circle size varies but the extrusion typically has a wall thickness of 1.5 mm and greater. The extrusion typically has ends cropped off and can be cut to desired lengths for subsequent operations. The extruded shape enters a quenching zone where it is then quenched, preferably by application of forced air cooling practices, that reduces the temperature of the extrusion to between approximately 250° F. to 450° F. Preferably the extruded product is at a temperature of about 350° F. as it exits the quenching zone. The cooling rate, that is the change in temperature of the extruded product as it traverses the quench zone is ultimately a function of the geometry of the extruded component, the speed at which the extruded product traverses the quenching zone, and the air temperature. In experimental trials, product was provided with a forced air quench to produce a cooling rate of 3° to 6° F./sec [2° to 3° C./sec]. The extruded component can then be stretched about ¼ to 1½% to straighten it if desired. The extruded product is naturally aged. Suitable properties are achieved within a natural aging period between four and thirty days.

The extruded component, with or without subsequent stretching, can be artificially aged to develop its strength properties. This typically includes heating above 250° or 270° F., typically above 300° F., for instance from about 330° to about 450° F. for a period of time from about an hour or a little less to about 10 or 15 hours, typically about 2 or 3 hours for temperatures about 350° to 400° F. The time used varies inversely with temperature (higher temperature for less time or lower temperature for longer time) and this develops so called peak or -T6 strength.

EXAMPLES

Extrusions representing three combinations of aluminum alloy composition and thermal processing were prepared for evaluation. Samples of each composition were extruded using water quenching and air quenching. The alloys designated "A" and "B" are 6063 type compositions that do not contain copper. Samples "A" were homogenized and artificially aged using the practices recommended by the Aluminum Association for production of 6063-T6; homogenization 4 hours at 1075° F. and aging 8 hours at 350° F. All other process steps were identical to those used for production of the other example materials. Samples "B" were homogenized and artificially aged according to the process of the invention. Finally, the alloy of this invention is designated "C" and contains approximately 0.2 vanadium. Table I also provides the registered composition range for 6063 aluminum alloy.

TABLE I

| | | Composition | | | | |
|---|---|---|---|---|---|---|
| Samples | Alloy | Si | Fe | Cu | Mg | V |
| A | 6063 | 0.48 | 0.24 | 0.02 | 0.47 | — |
| A | 6063 | 0.48 | 0.24 | 0.02 | 0.47 | — |
| B | 6XXX | 0.51 | 0.2 | — | 0.48 | — |
| B | 6XXX | 0.51 | 0.2 | — | 0.48 | — |
| C | New | 0.51 | 0.2 | — | 0.48 | 0.2 |
| C | New | 0.51 | 0.2 | — | 0.48 | 0.2 |
| 6063 | AA range | 0.2–0.6 | 0.35 max | 0.10 max | 0.45–0.9 | |

Table II sets forth the data obtained from the analysis of extruded product produced using water quenching. Three alloys, the commercially available (sample "A"), the 6063 type alloy (sample "B"), and the alloy of this invention (sample "C") were used to produce extruded product using a conventional water quench process. The extruded product was then aged to the -T6 temper and evaluated using the static axial crush test and standard tensile tests. In the evaluation of the product representing these materials, 3" sections of the extrusion were saw cut with ends parallel and subjected to axial displacement. This test rendered a crushed sample approximately 1.25" in height having one (1) severe fold. The deformed regions of the crushed product were then subject to a visual examination and assigned a crush rating as per the rating system described previously where a rating of "1" constitutes the desired outcome and a rating of "3" indicates the presence of cracking. The second column of Table II provides the results of a static axial crush test. As can be seen, all three alloys, when subject to water quenching, showed the preferred performance in the static axial crush test.

TABLE II

| | Spray Water Quenched Extruded Product | | Longitudinal Tensile Properties | | |
|---|---|---|---|---|---|
| Sample | Alloy | Crush Rating | Y (MPa) | UTS (MPa) | Elongation % |
| A | 6063 | 1 | 231 | 252 | 14.0 |
| A | 6063 | 1 | 226 | 252 | 13.5 |
| B | 6XXX | 1 | 217 | 234 | 13.5 |

TABLE II-continued

| Sample | Spray Water Quenched Extruded Product: Alloy | Crush Rating | Longitudinal Tensile Properties: Y (MPa) | UTS (MPa) | Elongation % |
|---|---|---|---|---|---|
| B | 6XXX | 1 | 214 | 233 | 13.5 |
| C | New | 1 | 215 | 235 | 13.5 |
| C | New | 1 | 209 | 229 | 13 |

The remaining Tables III and IV set forth the data obtained from the analysis of extruded product samples produced using forced air quenching. All three alloys; the 6063, the 6063 type, and the alloy of this invention were extruded using a forced air quench as described above. The extruded product samples were then aged to the -T6 temper and evaluated using the static axial crush test, longitudinal tensile tests, and test methods commonly used to indicate relative levels of fracture toughness, corrosion resistance and formability. The relative fracture toughness of these materials is indicated by comparing the unit propagation energy (UPE) values determined using the Kahn tear test. The relative corrosion resistance of these materials is compared through the use of bulk solution potential measurements. The relative formability of these materials was evaluated using the Olsen dome test under dry and lubricated conditions, and the guided bend test. The Olsen dome test is typically used to provide an indication of relative formability in sheet products. In this instance samples of the -T6 extrusion product were evaluated in the dry and lubricated conditions which simulate plane strain and equal biaxial forming conditions. In this test, a dry or lubricated punch is used to determine the dome height at which necking or failure occurs in the material under evaluation with a higher value indicating better relative formability. The guided bend test was originally developed to provide evaluation of formability under conditions designed to simulate sheet forming operations. Typically the samples evaluated represent -T4 sheet product that are given a 10% prestrain to simulate deformation expected in drawing operations and are subsequently bent over mandrels of different radii. Given the expected type of material deformation anticipated in the service application for this extrusion product, strip samples were evaluated in the -T6 condition and no prestrain was used. The desired outcome of this testing is the ability to bend over a smaller mandrel without cracking; data from this evaluation is typically expressed as a ratio of the limiting radius, R, over the thickness of the sample, t. In this case, a smaller R/t ratio indicates better relative formability.

The resultant data as shown in Table III and Table IV demonstrates that the forced air cooled aluminum alloy extrusions of 6063 and 6063 type materials demonstrated reduced levels of performance in the static axial crush test (as compared to extrusions that were subject to water quenching), while the new alloy of this invention maintained desirable performance levels and demonstrated performance results similar to those obtained on spray water quenched product. The aluminum alloy of this invention exhibits improved toughness as indicated by the unit propagation energy, UPE, values measured by the Kahn tear test with no adverse effect on strength. Typically in aluminum alloys, as toughness increases it does so at the cost of strength. Bulk solution potential measurements on these alloys are similar indicating that bulk corrosion performance can be expected to be comparable. Comparison of the results of the formability indicator tests illustrates that the tested extrusion of the alloy of the instant invention demonstrated desired increases in the measured results from both the dry and lubricated Olsen heights and a desired decrease in the guided bend radius achieved.

TABLE III

| Sample | Forced Air Quenched: Alloy | Y (MPa) | Transverse Tensiles: UTS | Elong. % | Longitudinal Tensiles: Y (MPa) | UTS | Elong. % | 45 Degree Tensiles: Y (MPa) | UTS | Elong. % | Elong. % |
|---|---|---|---|---|---|---|---|---|---|---|---|
| A | 6063 | | | | 214 | 246 | 14.0 | | | | |
| A | 6063 | 211 | 241 | 23.4 | 217 | 244 | 14.5 | 214 | 244 | 13.5 | 13 |
| B | 6XXX | | | | 219 | 241 | 13 | | | | |
| B | 6XXX | 215 | 239 | 26.7 | 219 | 241 | 13.5 | 217 | 239 | 12 | 12 |
| C | New | | | | 219 | 239 | 15 | | | | |
| C | New | 212 | 237 | 33.3 | 218 | 239 | 13 | 214 | 237 | 13.5 | 13 |

TABLE IV

| Sample | Alloy | Crush Rating | LT UPE (KJ/m^2) | TL UPE (KJ/m^2) | Solution Potential (mV v. SCE) | Olsen Dry Avg. mm | Olsen Wet Avg. mm | Guided Bend R/t |
|---|---|---|---|---|---|---|---|---|
| A | 6063 | 3 | — | — | — | — | — | — |
| A | 6063 | 3 | 180.4 | 104.9 | −0.756 | 0.2667 | 0.228 | 2.11 |
| B | 6XXX | 3 | — | — | — | — | — | — |
| B | 6XXX | 2 | 187.7 | 107.2 | −0.776 | 0.255 | 0.272 | 2.34 |
| C | New | 1 | — | — | — | — | — | — |
| C | Now | 1 | 236.1 | 179 | −0.746 | 0.2957 | 0.3647 | 1.64 |

Comparison of the results obtained in the evaluation of the several materials described in Table I is illustrated in the sole figure. Yield strength, fracture toughness, and formability indicator results, represent the average of measurements collected on the forced air cooled extrusion product samples. The data has been normalized with respect to the 6063 product to allow comparison. It is to be appreciated that the elimination of conventional water quench processing provides several distinct advantages. The need for a complex water quenching distribution, delivery, and recovery system is eliminated. The use of the air quench system increases the capacity to meet dimensional tolerances that are often impaired by water quenching. The positive impact on cost control and cost reduction occurs both in the extrusion processing stages and the post-extrusion processing of the extruded component. Post extrusion manual calibration of the extruded component is substantially reduced or even eliminated.

Unless indicated otherwise, the following definitions apply herein:

a. The term "ksi" is equivalent to kilopounds (1000 pounds) per square inch.

b. Percentages for a composition refer to % by weight.

c. The term "ingot-derived" means solidified from liquid metal by a known or subsequently developed casting process rather than through powder metallurgy techniques. This term shall include, but not be limited to, direct chill casting, electromagnetic casting, spray casting and any variations thereof.

d. In stating a numerical range or a minimum or a maximum for an element of a composition or a temperature or other process matter or any other matter herein, and apart from and in addition to the customary rules for rounding off numbers, such is intended to specifically designate and disclose each number, including each fraction and/or decimal, (i) within and between the stated minimum and maximum for a range, or (ii) at and above a stated minimum, or (iii) at and below a stated maximum. (For example, a range of 1 to 10 discloses 1.1, 1.2 . . . 1.9, 2, 2.1, 2.2 . . . and so on, up to 10, and a range of 500 to 1000 discloses 501, 502 . . . and so on, up to 1000, including every number and fraction or decimal therewithin, and "up to 5" discloses 0.01 . . . 0.1 . . . 1 and so on up to 5.)

Having described the presently preferred embodiments, it is to be understood that the invention may be otherwise embodied within the scope of the appended claims.

What is claimed is:

1. The method of producing an improved elongate aluminum alloy product comprising:

providing an alloy consisting of 0.45 to 0.7% magnesium, and about 0.35 to 0.6%, silicon, and about 0.1 to 0.35%, vanadium, and, 0.1–0.4% iron, the balance essentially aluminum;

extruding a body of said alloy; and air quenching said body of said alloy.

2. The method of producing an improved elongate aluminum alloy product according to claim 1 wherein the alloy is preferably about 0.48 to 0.64% magnesium.

3. The method of producing an improved elongate aluminum alloy product according to claim 1 wherein the alloy is preferably about 0.4 to 0.5% silicon.

4. The method of producing an improved elongate aluminum alloy product according to claim 1 wherein the alloy is preferably about 0.2% vanadium.

5. The method of producing an improved elongate aluminum alloy product according to claim 1 wherein the alloy is preferably about 0.48 to 0.64% magnesium; about 0.4 to 0.5% silicon; about 0.2% vanadium, and about 0.2% iron.

6. The method of producing an improved elongate aluminum alloy product according to claim 1 wherein said extruding is conducted with cylinder temperatures within about 700° to 1000° F.

7. The method of producing an improved elongate aluminum alloy product according to claim 1 wherein said quenching reduces the extruded product temperature to between about 250° F. to 450° F.

8. The method of producing an improved elongate aluminum alloy product according to claim 1 wherein said extruded product is stretched after quenching.

9. The method of producing an improved elongate aluminum alloy product according to claim 8 wherein the extruded product is straightened by an amount equivalent to approximately 1.50%.

10. The method of producing an improved elongate aluminum alloy product according to claim 9 wherein the extruded product is straightened by an amount equivalent to approximately 0.25%.

11. The method of producing an improved elongate aluminum alloy product according to claim 1 wherein the extruded product is a lineal frame member in a vehicle.

12. A product whose production includes the method of claim 1.

13. A product whose production includes the method of claim 2.

14. A product whose production includes the method of claim 3.

15. A product whose production includes the method of claim 4.

16. A product whose production includes the method of claim 5.

17. A product whose production includes the method of claim 6.

18. A product whose production includes the method of claim 7.

19. A product whose production includes the method of claim 8.

20. A product whose production includes the method of claim 9.

21. The method of producing an improved elongate aluminum alloy product comprising:

providing an alloy consisting of 0.45 to 0.7% magnesium, and about 0.35 to 0.6%, silicon, and about 0.1 to 0.35%, vanadium, and, 0.1–0.4% iron, the balance essentially aluminum;

heating said alloy;

extruding said alloy;

air quenching said extruded alloy;

artificially aging said extruded alloy.

22. The method of producing an improved elongate aluminum alloy product according to claim 21 including the step of stretching the extruded alloy.

23. A product whose production includes the method of claim 21.

24. The method of producing an improved elongate aluminum alloy product according to claim 21 wherein the alloy is preferably about 0.48 to 0.64% magnesium.

25. The method of producing an improved elongate aluminum alloy product according to claim 21 wherein the alloy is preferably about 0.4 to 0.5% silicon.

26. The method of producing an improved elongate aluminum alloy product according to claim 21 wherein the alloy is preferably about 0.2% vanadium.

27. The method of producing an improved elongate aluminum alloy product according to claim 21 wherein the alloy is preferably about 0.48 to 0.64% magnesium; about 0.4 to 0.5% silicon; about 0.2% vanadium, and about 0.2% iron.

28. In the production of a vehicular frame component wherein elongate aluminum alloy stock is shaped by one or more working operations into said frame component, the improvement wherein the production of said elongate stock include:

providing an alloy consisting of 0.45 to 0.7% magnesium, and about 0.35 to 0.6%, silicon, and about 0.1 to 0.35%, vanadium, and, 0.1–0.4% iron, the balance essentially aluminum;

heating said alloy;

extruding said alloy;

air quenching said extruded alloy;

stretching said alloy;

artificially aging said extruded alloy.

29. The production of a vehicular frame component wherein elongate aluminum alloy stock is shaped by one or more working operations into said frame component according to claim 28 wherein the alloy contains about 0.48 to 0.64% magnesium.

30. The production of a vehicular frame component wherein elongate aluminum alloy stock is shaped by one or more working operations into said frame component according to claim 28 wherein the alloy contains about 0.4 to 0.5% silicon.

31. The production of a vehicular frame component wherein elongate aluminum alloy stock is shaped by one or more working operations into said frame component according to claim 28 wherein the alloy contains about 0.2% vanadium.

32. The production of a vehicular frame component wherein elongate aluminum alloy stock is shaped by one or more working operations into said frame component according to claim 28 wherein the alloy is preferably about 0.48 to 0.64% magnesium; about 0.4 to 0.5% silicon; about 0.2% vanadium, and about 0.2% iron.

33. In the method of producing a vehicle frame wherein extruded shaped aluminum component members are joined to other components, the improvement wherein at least some of said component members are made by a method comprising:

providing an alloy consisting of 0.45 to 0.7% magnesium, and about 0.35 to 0.6%, silicon, and about 0.1 to 0.35%, vanadium, and 0.1–0.4% iron, the balance essentially aluminum;

heating said alloy;

extruding said alloy;

air quenching said extruded alloy; and artificially aging said extruded alloy.

34. The method according to claim 33 wherein the extruded shaped aluminum component members are joined to other components by welding.

35. The method according to claim 33 wherein the extruded shaped aluminum component members are joined to other components by adhesive bonding.

36. A vehicle frame comprising aluminum alloy extruded members joined to make a frame or subassembly, at least a plurality of said aluminum extruded members comprising aluminum alloy consisting of 0.45 to 0.7% magnesium, and about 0.35 to 0.6%, silicon, and about 0.1 to 0.35%, vanadium, and 0.1–0.4% iron, the balance essentially aluminum.

37. The vehicle frame comprising aluminum alloy extruded members joined to make a frame or subassembly, at least a plurality of said aluminum extruded members according to claim 36 wherein the alloy is preferably about 0.48 to 0.64% magnesium.

38. The vehicle frame comprising aluminum alloy extruded members joined to make a frame or subassembly, at least a plurality of said aluminum extruded members according to claim 36 wherein the alloy is preferably about 0.4 to 0.5% silicon.

39. The vehicle frame comprising aluminum alloy extruded members joined to make a frame or subassembly, at least a plurality of said aluminum extruded members according to claim 36 wherein the alloy is preferably about 0.2% vanadium.

40. The vehicle frame comprising aluminum alloy extruded members joined to make a frame or subassembly at least a plurality of said aluminum extruded members according to claim 36 wherein the alloy is preferably about 0.48 to 0.64% magnesium; about 0.4 to 0.5% silicon; about 0.2% vanadium, and about 0.2% iron.

41. The method of producing an improved elongate aluminum alloy product comprising:

providing an alloy consisting of 0.45 to 0.7% magnesium, and about 0.35 to 0.6%, silicon, and about 0.1 to 0.35%, vanadium, and, 0.1–0.4% iron, the balance essentially aluminum;

extruding a body of said alloy; and quenching said body of said alloy.

42. The method of producing an improved elongate aluminum product according to claim 41 wherein the step of quenching the body of the alloy comprises water quenching.

43. The method of producing an improved elongate aluminum alloy product according to claim 42 wherein the alloy is preferably about 0.48 to 0.64% magnesium.

44. The method of producing an improved elongate aluminum alloy product according to claim 42 wherein the alloy is preferably about 0.4 to 0.5% silicon.

45. The method of producing an improved elongate aluminum alloy product according to claim 42 wherein the alloy is preferably about 0.2% vanadium.

46. The method of producing an improved elongate aluminum alloy product according to claim 42 wherein the alloy is preferably about 0.48 to 0.64% magnesium; about 0.4 to 0.5% silicon; about 0.2% vanadium, and about 0.2% iron.

47. The method of producing an improved elongate aluminum alloy product according to claim 42 wherein the extruded product is stretched.

48. The method of producing an improved elongate aluminum alloy product according to claim 42 wherein the extruded product is straightened by an amount equivalent to approximately 1.50%.

49. The method of producing an improved elongate aluminum alloy product according to claim 48 wherein the extruded product is straightened by an amount equivalent to approximately 0.25%.

50. The method of producing an improved elongate aluminum alloy product according to claim 40 wherein the extruded product is a lineal frame member in a vehicle.

51. A product whose production includes the method of claim 41.

52. A product whose production includes the method of claim 42.

53. A product whose production includes the method of claim 43.

54. A product whose production includes the method of claim 44.

55. A product whose production includes the method of claim 45.

56. A product whose production includes the method of claim 46.

57. A product whose production includes the method of claim 47.

58. A product whose production includes the method of claim 48.

59. A product whose production includes the method of claim 49.

60. A product whose production includes the method of claim 50.

* * * * *

UNITED STATES PATENT AND TRADEMARK OFFICE

CERTIFICATE OF CORRECTION

PATENT NO. : 5,527,404

DATED : June 18, 1996

INVENTOR(S) : Allison S. Warren

It is certified that error appears in the above-indentified patent and that said Letters Patent is hereby corrected as shown below:

Col. 12, Claim 50 should depend on claim 42

Signed and Sealed this

Twenty-fifth Day of February, 1997

*Attest:*

*Attesting Officer*

BRUCE LEHMAN

*Commissioner of Patents and Trademarks*